United States Patent [19]

Intrater et al.

[11] 4,294,271

[45] Oct. 13, 1981

[54] APPARATUS FOR REMOVING DEPOSITED MATTER FROM A DIFFUSION TUBE

[75] Inventors: Josef Intrater, Englewood Cliffs, N.J.; Gene Bertholdo, New York, N.Y.; Janet Intrater, Englewood Cliffs, N.J.

[73] Assignee: Dexon, Inc., Minneapolis, Minn.

[21] Appl. No.: 98,756

[22] Filed: Nov. 30, 1979

[51] Int. Cl.[3] ..... B08B 3/02; B08B 9/02

[52] U.S. Cl. ..... 134/113; 134/169 C; 134/171; 134/200

[58] Field of Search ..... 134/22 C, 36, 95, 103, 134/113, 166 R, 166 C, 167 C–169 C, 170–171, 200; 118/317

[56] References Cited

U.S. PATENT DOCUMENTS

| | | | |
|---|---|---|---|
| 1,447,304 | 3/1923 | Hauk | 134/95 |
| 3,208,460 | 9/1965 | Heinicke | 134/22 C X |
| 3,441,035 | 4/1969 | Edwards | 134/103 |
| 3,583,413 | 6/1971 | Mertzanis | 134/200 X |
| 3,624,750 | 11/1971 | Peterson | 134/200 X |
| 3,630,777 | 12/1971 | Ishizawa et al. | 134/169 R X |
| 3,645,283 | 2/1972 | Cassells | 134/95 X |
| 4,064,886 | 12/1977 | Heckele | 134/169 C X |
| 4,224,108 | 9/1980 | Takahashi et al. | 134/168 R X |

FOREIGN PATENT DOCUMENTS

| | | | |
|---|---|---|---|
| 2063007 | 7/1971 | France | 134/95 |
| 698103 | 10/1953 | United Kingdom | 134/168 R |

*Primary Examiner*—Robert L. Bleutge

*Attorney, Agent, or Firm*—Dorsey, Windhorst, Hannaford, Whitney & Halladay

[57] ABSTRACT

Apparatus for removing deposited matter, such as silicon and contaminants, from the interior of quartz diffusion tubes including an acid holding tank; a quartz-tube support for vertically holding the tube, neck down; a flexible seal for connecting the neck of the tube to the holding tank; an immersion pump and associated tubing for circulating the acid; and a spray head, connected with the pump and tubing, to spray the acid against the inside surface of the quartz tube to clean off the deposited matter. In order to prevent the acid sprayed on the inside surface from forming channels in the silicon or other deposited matter, two groups of nozzles are provided in the spray head—one group with its nozzles arranged at about 30° from vertical, the other group with its nozzles arranged at about 60° from vertical—so that the jets sprayed from each of the two groups are directed 90° from one another; a diverter valve alternately connects the two groups of nozzles to the pump; as the flow of acid is switched from one group of nozzles to the other, the jets of acid are caused to sweep from the direction of one group of nozzles to that of the other, and no channelization is permitted to occur.

28 Claims, 7 Drawing Figures

APPARATUS FOR REMOVING DEPOSITED MATTER FROM A DIFFUSION TUBE

BACKGROUND OF THE INVENTION

This invention relates to apparatus for cleaning hollow vessels, and more particularly relates to apparatus for removing deposited matter, such as deposited silicon, from the inside of a quartz diffusion tube.

Quartz diffusion tubes are used in the semiconductor industry to carry out chemical vapor deposition and epitaxy deposition. During a chemical vapor deposition or epitaxy process, silicon wafers are enclosed within the quartz diffusion tube and then vapors are introduced into the tube. These vapors act on the silicon wafers to cause the desired features to be formed on them. However, these processes also cause the inner surface of the tube to be covered with a layer of silicon as well as other unwanted by-products. Before the quartz tube can be used again, this contaminating layer must be removed. Conventionally this is done by immersing the tube in a vat containing a reagent, usually a mixture of nitric acid and hydrofluoric acids, and then rinsing the tube thoroughly in a vat of deionized water.

Such a conventional cleaning operation, even though it has been necessary in preparing the tube for subsequent use, is dangerous to human technicians, shortens the life of the tube, and consumes a great amount of floor space as well as large quantities of reagent.

Conventionally, a technician must pick the diffusion tube up by hand and then carefully lay it into a vat containing ten gallons or more of nitric and hydrofluoric acids. These acids are highly corrosive and can cause severe and painful chemical burns if accidentally brought into contact with human skin. If hydrofluoric acid reaches certain sensitive regions, such as the skin under the fingernails, extremely painful sores result. Despite the fact that the technician will take all the usual precautions, such as the wearing of rubber gloves, and that he will exercise the greatest care while handling the diffusion tubes, such chemical burns will inevitably occur.

Further, the reaction of nitric acid with the silicon gives off toxic nitrous oxide gas. Even though the cleaning is carried out under a ventilation hood, there is still a danger to the health of the technician.

Because the quartz tubes are manually lifted into and out of the chemical vats, there is also a danger of breakage to the diffusion tubes. As these tubes are rather expensive, it would be desirable to minimize the handling of the tubes and thereby reduce the probability of breakage.

The acid in the vat etches both the inside and the outside of the diffusion tube, even though only the inside needs to have the silicon removed. In each cleaning, the acid etches away some of the quartz from the diffusion tube, and reduces the remaining life of the diffusion tube. Etching the exterior of the tube unnecessarily shortens the tube life.

Furthermore, the vat of acid, the vat of deionized water, and the hood require an arrangement that occupies a relatively large floor space, usually a space of at least eight feet by three feet.

OBJECTS AND SUMMARY OF THE INVENTION

Among the objects of the present invention are to provide an apparatus for cleaning quartz diffusion tubes which avoids the problems inherent in the conventional technique; to provide such an apparatus which affords relative safety to the technician operating it; to provide such an apparatus which affords a greater lifetime to the diffusion tubes; and to provide such an apparatus which is relatively compact as compared with arrangements according to the prior art.

It is a further object of this invention to provide an apparatus for removing deposited matter from diffusion tubes in which the acid used to remove the matter is contacted only with the inside surface of the tube.

It is a still further object of this invention to provide such an apparatus in which less than a gallon of acid is required to clean the tube.

It is another object of this invention to provide such an apparatus in which noxious gases resulting from the reaction of the acid with the deposited matter are contained within the apparatus and vented safely off without presenting a danger to the technician operating the apparatus.

It is yet another object of this invention to provide an apparatus which permits hands-off cleaning of the deposited matter from the diffusion tube.

According to an aspect of this invention, an apparatus is provided for removing deposited matter, such as silicon and other contaminants, from the interior of a quartz diffusion tube. Such apparatus comprises an acid holding tank; a diffusion tube support for vertically supporting the tube, neck down; a flexible seal for connecting the neck of the tube to the holding tank; an immersion pump and associated tubing for circulating the acid from the holding tank; and a spray head, connected with the pump and tubing, to spray the acid against the inside surface of the diffusion tube to clean the deposited matter off. In order to prevent the acid sprayed on the inside surface from forming channels in the silicon or other deposited matter, two groups of nozzles are preferably provided in the spray head—one group with its nozzles arranged to spray about 30° from vertical, the other group with its nozzles arranged to spray about 60° from vertical—so that the acid sprayed from each of the two groups is directed about 90° from one another. The flow of acid is gradually switched from one group of nozzles to the other, thereby causing the direction of spray of the acid to sweep through 90°, and thus preventing channels from forming in the silicon.

In a preferred construction, the present invention also includes a cabinet to completely enclose the diffusion tube, spray head, holding tank, pump, and tubing during a cleaning operation. The cabinet has an interlock to prevent the apparatus from circulating and spraying the acid unless a door to the cabinet is closed. The preferred construction further includes a showering system for spraying deionized water onto the outside surface of the diffusion tube during the cleaning operation. This showering system is in continuous operation while the acid is being sprayed on the inside of the tube. As a result, if a fracture should occur in the tube, any acid leaking to the outside of the tube will be instantly diluted to a harmless concentration by the deionized water. An interlock can be conveniently provided in the showering system so that the immersion pump operates only so long as the showering system is spraying, thereby making the apparatus fail-safe.

Still other features and advantages of the present invention will become apparent on consideration of the following description when read in conjunction with the accompanying drawings.

DETAILED DESCRIPTION OF THE PREFERRED EMBODIMENT

Figure 1:
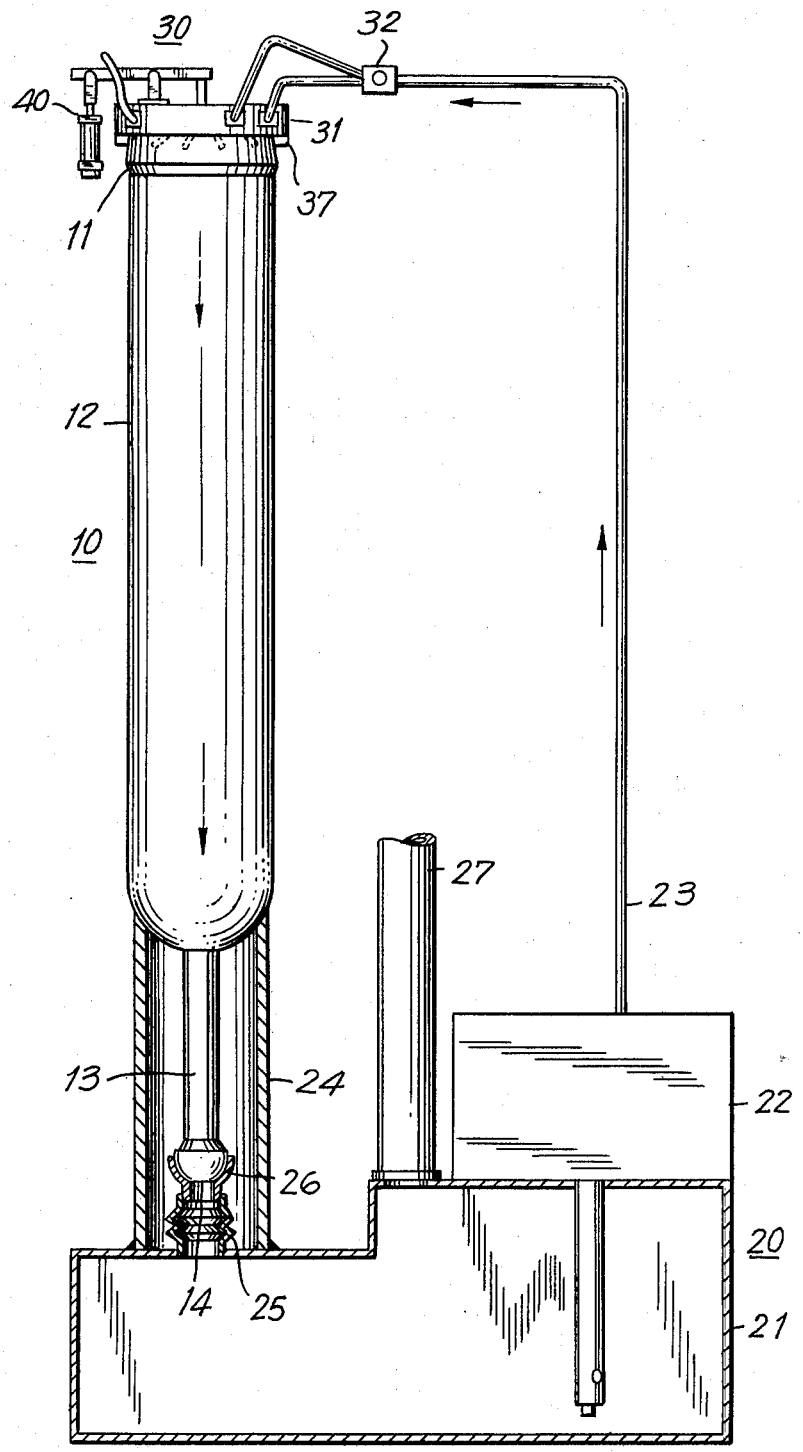
FIG. 1 is a schematic drawing of diffusion tube cleaning apparatus, with a tube in place, according to this invention.

With reference to the drawings, FIG. 1 shows an apparatus for cleaning deposited matter, such as silicon, from the inside surface of a quartz diffusion tube. Such a quartz diffusion tube 10 is shown in place in the apparatus. The tube 10 has a large, upper opening 11 at one end of a body 12 thereof, a neck 13 at the other end of the body 12, and a small, lower opening 14 at the end of the neck 13. The diffusion tube 10 shown in this embodiment is generally circular in cross-section, but other shapes are common, and the present invention could readily be adapted for the cleaning of diffusion tubes of square, rectangular, or other cross-sections.

An acid-circulating system 20 is provided for circulating a reagent, usually a mixture of nitric acid and hydrofluoric acid, to wash the deposited silicon from the inside surface of the tube 10. Here, the circulating system includes an acid holding tank 21, an immersible pump 22, and piping 23 for circulating the acid from the pump 22. As the acid holding tank 21, the immersible pump 22, and the piping 23 must be resistant to hydrofluoric and nitric acids, it is preferred that they be constructed of polypropylene. Polyfluoroethylene (i.e., E. I. DuPont & Co.'s Teflon [TM]) could also be used, but is somewhat less satisfactory.

The apparatus further includes a support 24 for the diffusion tube 10. Here, since the body 12 of the diffusion tube has a wider diameter than that of the neck 13 and second opening 14, the support 24 is arranged to support the tube 10 at the wider-diameter portion of the body 12, thereby reducing danger of breakage of the neck 13.

A flexible member 25 and a flexible seal 26 sealably connect the opening 14 of the tube 10 with the acid holding tank 21. As shown in FIG. 1, the flexible member is an accordion-like length of resilient tubing and urges the flexible seal 26 against the neck 13 so that the seal 26 forms a gas-tight, acid-tight seal. The accordion-like flexible member 25 can also accommodate variations in the length of the neck and the angle of the neck in respect to the body among various diffusion tubes 10 which are to be cleaned of deposited matter.

A gas exhaust pipe 27 is connected to the acid holding tank 21 so that any noxious gases, such as nitrous oxide, resulting from the reaction of the acid with the deposited matter, can be vented away to a remote area, thereby eliminating a serious hazard to the technician operating the apparatus.

Figure 2:
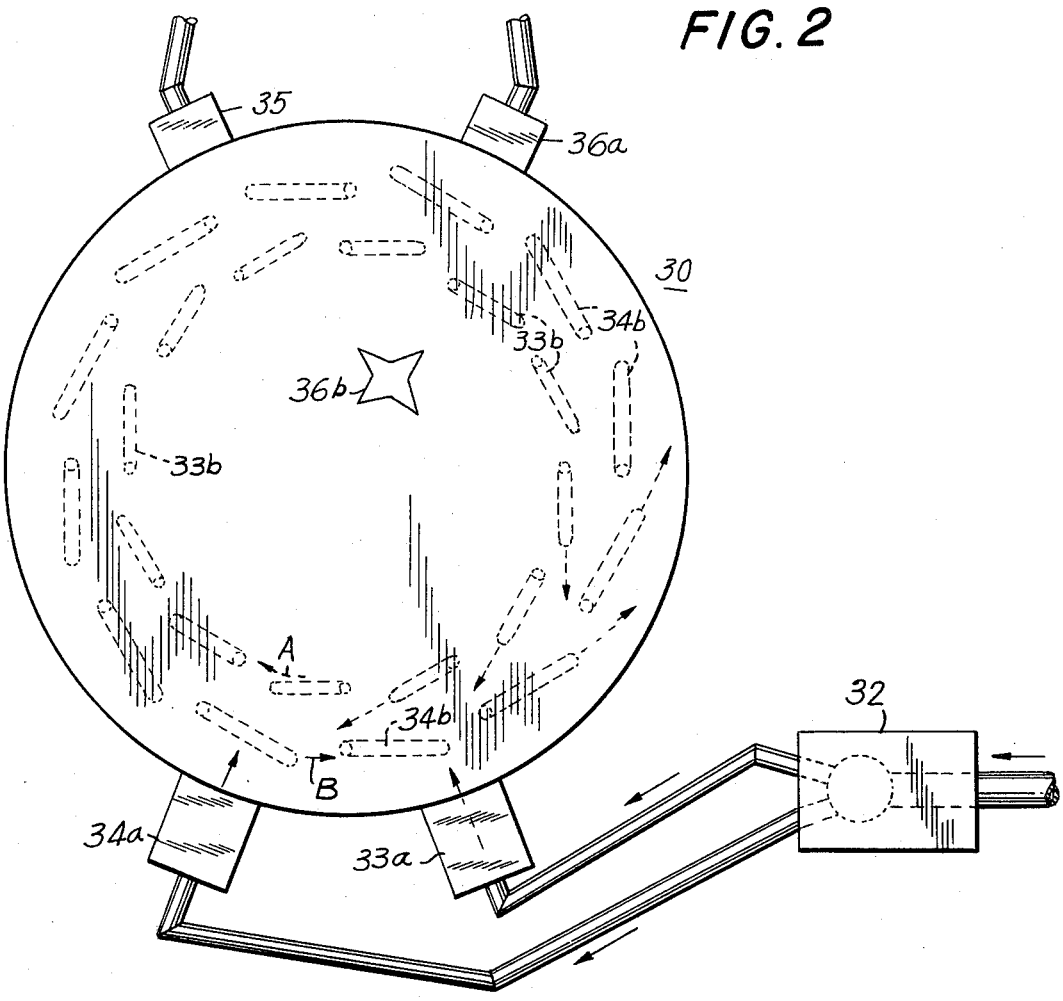
FIG. 2 is a plan view of a spray head according to this invention.
Figure 3:
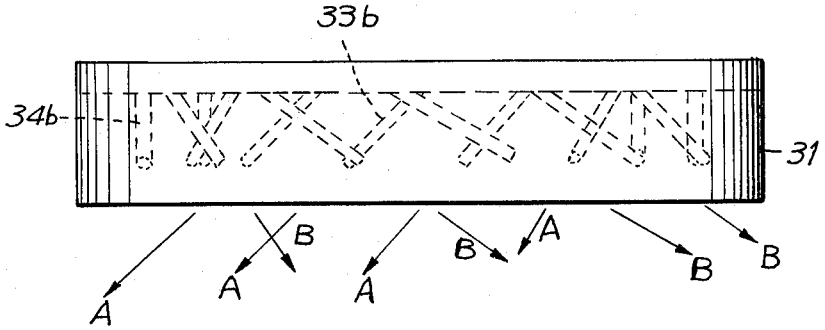
FIG. 3 is a simplified side view of the spray head.

Acid is circulated through the piping 23 to a spray head assembly 30 which is shown in greater detail in FIGS. 2 and 3. Also included in this embodiment is a pneumatically-operated device 40, of conventional design, for remotely lowering and automatically centering the spray head 30 in respect to the large opening 11 of the tube 10.

As shown in FIG. 2, the spray head assembly 30 includes a circular body 31 formed of a material resistant to nitric and hydrofluoric acids, such as polypropylene. The piping 23 connects the immersion pump 22 to a diverter valve 32, which can be either electrically (solenoid) or pneumatically operated. The diverter valve 32 alternately supplies the circulating acid to a first acid inlet connector **33*a* and thence to its associated spray nozzles 33*b*, and to a second acid inlet connector 34*a* and thence to its associated spray nozzles 34*b*. As shown in FIG. 2, the spray nozzles 33*b* are arranged in a circular group about the center of the body 31, and the nozzles 34*b*** are arranged in a concentric circular group.

Further, a deionized water inlet connector 35 on the body 31 receives deionized water and supplies it through another valve, not shown, to the nozzles **33*b*, 33*b* for carrying out a rinsing operation, as described below. Also a drying gas inlet connector 36*a* receives a drying gas, such as nitrogen, and supplies it to a gas jet 36*b* for drying out the tube 10** following a cleaning operation.

Returning for the moment to FIG. 1, the spray head 30 also includes a gasket 37 on a lower surface thereof for sealably contacting the large opening 11. This gasket 37 should be made of an acid resistant material, such as the synthetic rubber marketed as Viton by E. I. DuPont & Company.

Each of the groups of nozzles **33*b*, 34*b* is arranged to spray the acid in respective directions A, B separated by about 90°. As shown in FIG. 3, the first group of nozzles sprays the acid in the direction A at about 30° from vertical, and the second group of nozzles 34*b*** sprays the acid in the direction B at about 60° from vertical.

The significance of the arrangement of the groups of nozzles **33*b*, 34*b*** can be explained as follows.

If acid is sprayed in only a single direction against the silicon deposited on the inner wall of the quartz tube 10, the stream of acid will tend to preferably erode some areas of silicon more than others. As a result, channels are formed in the silicon. These channels represent areas of least resistance, and subsequent streams of acid will continue to follow the same channels. As a result, while the silicon is not completely removed in some areas, in the area of the channels the silicon will be completely removed and then the quartz material of the diffusion tube itself will be eroded by the acid.

The arrangement of the present invention avoids such channelization by the use of the diverter valve 32 and the groups of nozzles **33*b*, 34*b*. The diverter valve 32 periodically cuts over the supply of circulating acid from one group of nozzles 33*b* to the other 34*b*, and then cuts it back again. That is, initially, when the acid is supplied to the first set of nozzles 33*b*, the acid is sprayed in one direction A with respect to the inside surface of the tube 10. Then, as the diverter valve 32 begins to cut off the supply of acid to the nozzles 33*b*, the pressure of the acid sprayed from the nozzles 33*b* is lowered, and the direction of the acid spray begins to approach the vertical. Meanwhile, as the flow of acid commences to the second group of nozzles 34*b*, the acid at first trickles therefrom substantially in the vertical direction, and, as the valve 32 is brought more fully into connection with the inlet 34***a* and the pressure is increased, the direction of acid spray from the nozzles 34*b* sweeps up toward the direction B in respect to the inside surface of the diffusion tube 10. Thus, in effect, the spray head 30 causes jets of acid to sweep between a first angle of incidence A and a second angle of incidence B in respect to the inside surface of the tube, and thereby prevents channels from forming in the deposited silicon.

As the diverter valve switches back so as to cut over the flow of acid to the first group of nozzles 33*b*, a reverse of the above-described sweep operation is performed.

Figure 4:
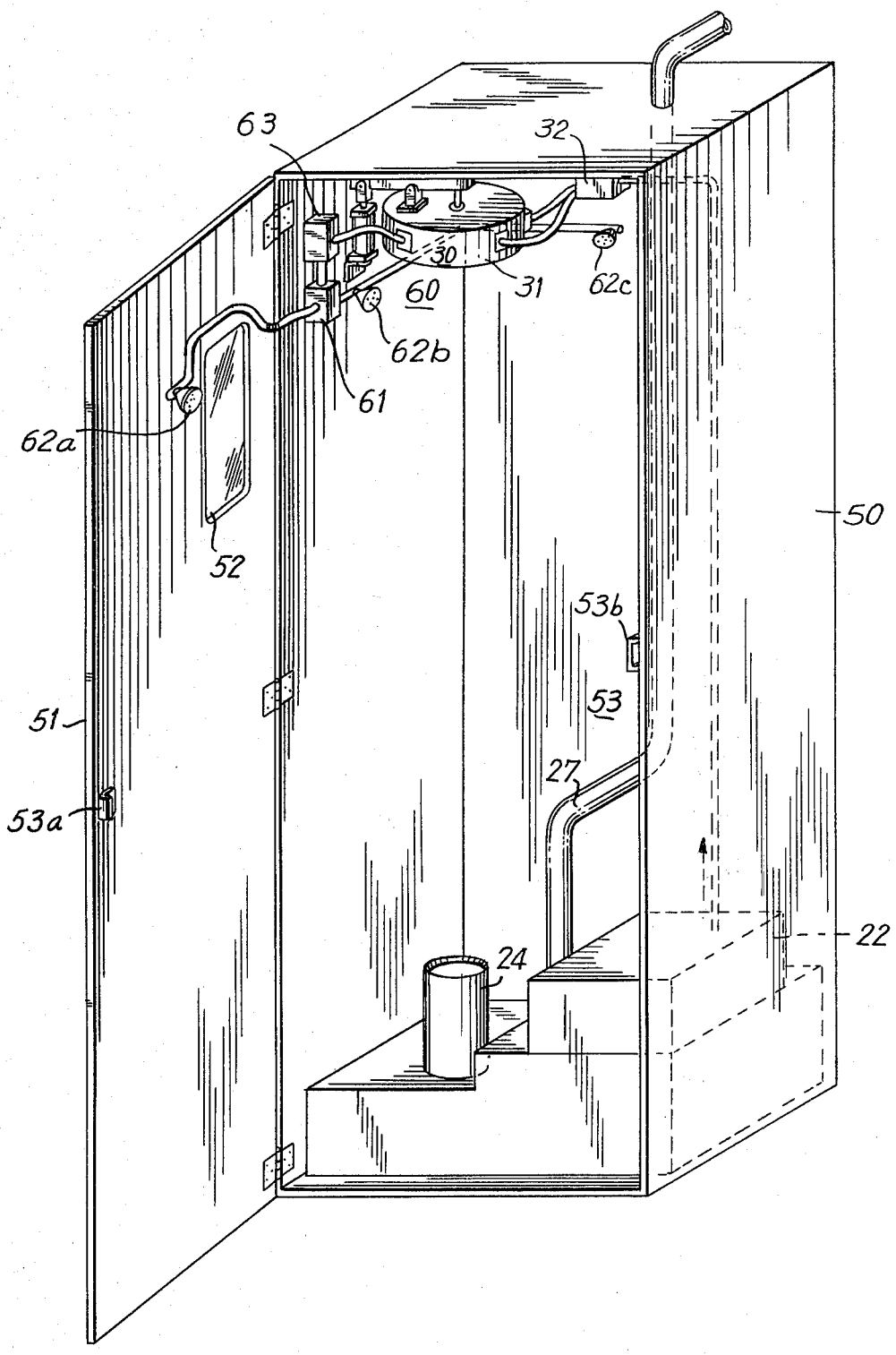
FIG. 4 is a perspective view of the diffusion tube cleaning apparatus showings its enclosure and other ancillary features.

A perspective view of a complete apparatus according to this invention is shown in FIG. 4, in which similar reference numerals are used to identify elements of the invention also shown in FIGS. 1–3. A detailed description of those elements is omitted. The embodiment shown herein includes a cabinet 50 for completely enclosing the tube, the spray head 30, and the circulating system 20, during a cleaning operation. A door 51 provides access to the apparatus. A viewing port or window 52 is included in the door 51 so that a technician can monitor the removal of silicon from the tube. An interlock 53 is provided to inhibit circulation and spraying of the acid unless the door 51 is closed. In this embodiment, the interlock consists of a magnet 53*a* affixed to the door 51 and a magnetic switch 53*b* positioned within the cabinet 50.

Also within the cabinet is a deionized-water showering system 60 for continuously bathing the outside of the tube with deionized water during a cleaning operation. The system includes an inlet control 61 which has an interlock incorporated within it so that the circulating and spraying of acid is inhibited in the event that the showering of the deionized water should cease. The deionized water is furnished from the inlet control 61 to a number of showering heads 62*a*, 62*b*, 62*c* located within the cabinet 50. The inlet control 61 also supplies water to a metering control 63 which in turn feeds deionized water to the deionized water inlet connector 35*a* on the head 30. Hidden from view in FIG. 4 are a gas inlet and a control for supplying nitrogen to the drying gas inlet connection 36*a*, and also hidden from view are the various acid and deionized-water drains and outlets, all of which are conventional.

The cabinet 50 and door 51 are formed of polypropylene so as to be resistant to the action of nitric and hydrofluoric acids.

It is appreciated that the apparatus described above occupies a relatively small floor space, in this example, a space 24 inches across by 15 inches deep.

The apparatus of this invention is operated quite simply. To begin a cleaning operation, a diffusion tube 10 to be cleaned is inserted, neck down, in the apparatus. Then, the technician pours a sufficient amount of acid into the holding tank (500 ml is usually sufficient), closes the door 51, remotely lowers the spray head 30, and then activates the pump 22. Once activated, the pump 22 continuously recirculates the acid until the inside of the diffusion tube 10 is clean. When the tube is sufficiently clean, the acid is drained from the holding tank 21 and emptied into a waste acid tank, and then deionized water is sprayed on the inside of the tube 10. The deionized water can be recirculated, or can be flushed. Following a complete rinsing of the tube, a drying gas (nitrogen) is introduced to dry the tube. Finally, the cleaned tube is removed.

As mentioned above, while the etching of the deposited silicon is proceeding, the outside of the tube is continuously being showered with water. As a result, if a fracture should occur in the tube, any acid leaking to the outside of the tube is immediately diluted to a harmless strength. Furthermore, the enclosure of the entire system, with the interlocks 53 and 61, makes the operation of this apparatus fail-safe.

Figure 5A:
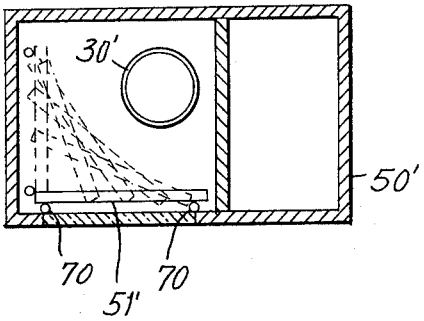
FIGS. 5A and 5B are views showing an alternative construction of the enclosure of FIG. 4.
Figure 5B:
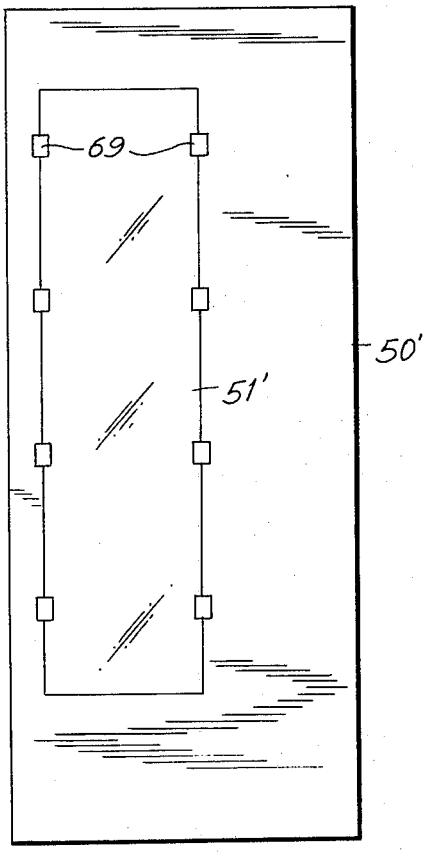

FIGS. 5A and 5B are top and front elevational views, respectively, of another enclosure for the apparatus of this invention. The same reference numerals, but primed, are used to identify elements shown also in FIG. 4. Here the door 51' is not hung on hinges, and does not open outwardly. Instead the door 51' is hung on a track (not shown) inside the cabinet 50' and integral with the top thereof. The door 51' which is made of transparent plastic is sealed shut by the gaskets 70 attached to the door 51' and is held closed by means of latches 69. This arrangement affords an especially water-tight and acid-tight seal.

Figure 6:
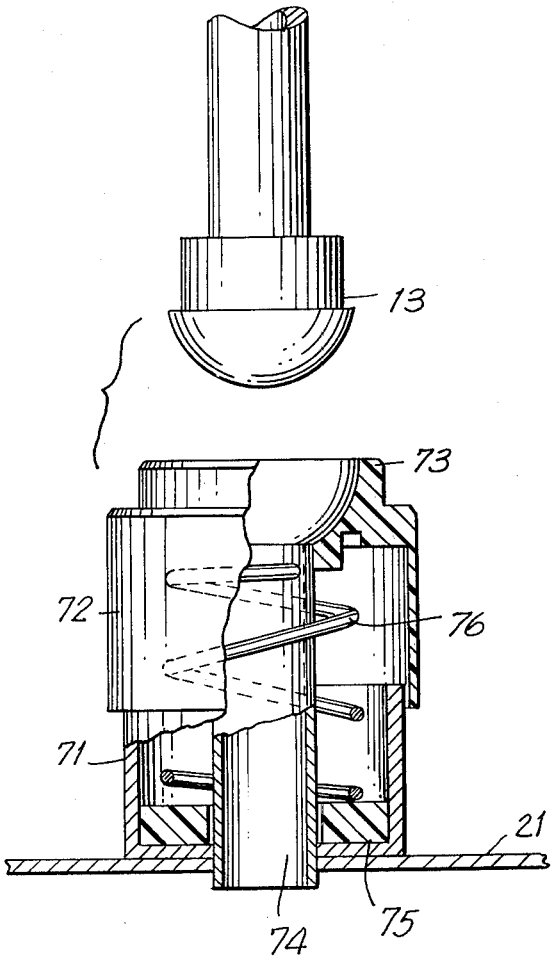
FIG. 6 is an elevational view showing an alternate arrangement of a part of this invention.

FIG. 6 shows an alternative arrangement to the flexible sealing member 25, 26 of FIG. 1. Here the arrangement is formed of an inner cup 71 atop the holding tank 21, and an outer cup 72 above and coaxial with the inner cup 71, and situated to slide axially in respect to the latter. Both cups 71, 72 are made of polypropylene. The outer cup 72 has a seal portion 73 for contacting the neck end 13 of a quartz tube, and a tube portion 74 which fits through a Teflon ring 75 situated at the bottom of the inner cup 71. A stainless steel spring 76, encapsulated in Teflon, and which biases the seal portion 73 against the neck 13 of the tube, will last indefinitely. Further, the inner-cup/outer-cup arrangement prevents water from seeping into the holding tank 21.

While the apparatus described in detail above is constructed specifically as an arrangement for removing deposited matter such as silicon from a quartz diffusion tube, it can be readily appreciated that the principles and features of this invention can be applied to various other purposes by persons of ordinary skill in the art. Therefore, it is to be understood that the invention is not limited to this particular embodiment, and that various changes and modifications may be effected therein without departing from the scope or spirit of the invention, which is to be ascertained from the appended claims.

We claim:

1. Apparatus for removing deposited matter from a diffusion tube having a first opening at one end thereof and a second opening at the other end thereof, said apparatus comprising:

a reagent holding container for holding an acid reagent to remove said matter from said tube;

means removably supporting said tube in an upright position so that acid reagent will flow downwardly from said first opening to said second opening;

means for sealably connecting said second opening with said reagent holding container, while the tube is supported in said upright position;

circulating means for circulating said acid reagent from said holding container; and a spray head connected with said circulating means, means for sealably contacting said spray head with said first opening while the tube is supported in upright position, and said spray head having spraying means for spraying said acid reagent against only the inside surface of said tube at said first opening.

2. Apparatus according to claim 1, wherein said diffusion tube is a quartz diffusion tube, said reagent is a mixture of nitric acid and hydrofluoric acid, and said spray head, said holding tank, and said circulating means are constructed of material resistant to said mixture of acids.

3. Apparatus according to claim 2, wherein the material in said spray head includes polypropylene and the material in said gasket means includes an inert elastomer.

4. Apparatus according to claim 1, wherein said spraying means includes means to prevent said reagent from forming channels in the deposited matter, said means to prevent including means for spraying reagent circumferentially along the inside surface of the tube at said first opening.

5. Apparatus for removing deposited matter from a diffusion tube having a first opening at one end thereof and a second opening at the other end thereof, said apparatus comprising:

a reagent holding container for holding reagent to remove said matter from said tube;

means supporting said tube in an upright position so that acid will flow from said first opening to said second opening;

means for connecting said second opening with said reagent holding container;

circulating means for circulating said acid from said holding container; and a spray head connected with said circulating means contacting said first opening and having spraying means for spraying said reagent against the inside surface of said tube wherein said spraying means includes means to prevent said reagent from forming channels in the deposited matter, and wherein said means to prevent includes means to cause jets of reagent to sweep between a first and a second angle of incidence in respect to the inside surface of said tube.

6. Apparatus for removing deposited matter from a diffusion tube having a first opening at one end thereof and a second opening at the other end thereof, said apparatus comprising:

a reagent holding container for holding reagent to remove said matter from said tube;

means supporting said tube in an upright position so that acid will flow from said first opening to said second opening;

means for connecting said second opening with said reagent holding container;

circulating means for circulating said acid from said holding container; and a spray head connected with said circulating means contacting said first opening and having spraying means for spraying said reagent against the inside surface of said tube wherein said spraying means includes means to prevent said reagent from forming channels in the deposited matter, and wherein said spraying means includes a first plurality of nozzles arranged to spray said reagent in a first direction in respect to the inside surface of said tube and a second plurality of nozzles arranged to spray said reagent in a second direction in respect to said inside surface; and said means to prevent includes a valve for alternately connecting said first and said second plurality of nozzles to said circulating means.

7. Apparatus according to claim 6, wherein said first and said second directions are separated by about 90°.

8. Apparatus according to claim 1, further comprising vent pipe means connected with said holding container for venting off gases resulting from reaction of said reagent with said deposited matter.

9. Apparatus according to claim 1, further comprising showering means for providing the outside surface of said tube, during a deposited matter removing operation, with a shower of an inert fluid.

10. Apparatus for removing deposited matter from a diffusion tube having a first opening at one end thereof and a second opening at the other end thereof; said apparatus comprising:

a reagent holding container for holding reagent to remove said matter from said tube;

means supporting said tube in an upright position so that acid will flow from said first opening to said second opening;

means for connecting said second opening with said reagent holding container;

circulating means for circulating said acid from said holding container; and a spray head connected with said circulating means contacting said first opening and having spraying means for spraying said reagent against the inside surface of said tube, said apparatus further comprising showering means for providing the outside surface of said tube, during a removing operation, with a shower of an inert fluid, and wherein said showering means includes an interlock to inhibit the circulation and spraying of said reagent in the event showering of said inert fluid ceases.

11. Apparatus according to claim 1, further comprising enclosure means for enclosing said tube, said spray head, said holding container, and said circulation means; said enclosure means including a door for providing access to the interior of said enclosure means.

12. Apparatus according to claim 11, wherein said enclosure means is formed of material resistant to said reagent.

13. Apparatus according to claim 11, wherein said enclosure means includes a transparent viewing port positioned so that an operator can monitor the removal of said matter from said tube.

14. Apparatus according to claim 11, further comprising an interlock to inhibit the circulation and spraying of said reagent unless said door is closed.

15. Apparatus according to claim 1, further comprising means for remotely lowering and centering said spray head in respect to said first opening of said tube.

16. Apparatus according to claim 1, wherein said diffusion tube has a body of a diameter wider than that of said second opening and is formed with a neck at said other end connecting said body with said second opening, and said means supporting said tube supports the body of the latter substantially at said wider diameter, thereby reducing the danger of breakage of said neck.

17. Apparatus according to claim 16, wherein said means for sealably connecting said second opening with said reagent holding tank includes sealing means for sealably contacting said neck at said second opening to form a gas-tight, reagent-tight seal and a flexible, resilient tube connecting said sealing means and said holding tank and urging said sealing means against said neck despite variations in length of the neck and angle thereof in respect to said body among various diffusion tubes to have deposited matter removed therefrom.

18. A spray head device for use in cleaning a diffusion tube of matter deposited therewithin comprising:

a body portion;

sealing means for sealably contacting an opening at one end of said tube;

spraying means for spraying a reagent against the inside surface of said tube;

means for providing a flow of said reagent to said spraying means; and means to prevent said reagent sprayed by said spraying means from forming channels in said deposited matter, said means to prevent including spray nozzles for spraying the reagent circumferentially and longitudinally along the inside surface of said tube at said opening.

19. A spray head device for use in cleaning a diffusion tube of matter deposited therewithin comprising:

a body portion;

sealing means for sealably contacting an opening in said tube;

spraying means for spraying a reagent against the inside surface of said tube;

means for providing a flow of said reagent to said spraying means; and means to prevent said reagent sprayed by said spraying means from forming channels in said deposited matter, wherein said spraying means includes a first plurality of nozzles arranged to spray said reagent at a first angle in respect to the inside surface of said tube and a second plurality of nozzles arranged to spray said reagent at a second angle in respect to said inside surface; and said means to prevent said reagent from forming channels includes a valve for alternately connecting said first and second plurality of nozzles to said means providing a flow of said reagent.

20. A spray head device according to claim 19, wherein said first and said second angles are separated by substantially 90°.

21. A spray head device according to claim 20, wherein said first direction is approximately 30° from vertical while said second direction is approximately 60° from vertical.

22. A shower head device according to claim 19, wherein said first plurality of nozzles and said second plurality of nozzles are arranged with the nozzles of each said plurality in a respective concentric ring.

23. A shower head device according to claim 19, further comprising means for spraying the inside surface of said tube with an inert fluid following the cleaning of said matter from said tube; and means providing said inert fluid to said means for spraying.

24. A shower head device according to claim 18, wherein said sealing means includes a gasket formed of a material resistant to said reagent.

25. A shower head device according to claim 18, further comprising means for drying said tube subsequent to said cleaning thereof.

26. A shower head device according to claim 25, wherein said means for drying includes a port for injecting a drying gas into the interior of said tube, and means for supplying said drying gas.

27. A shower head device according to claim 18, wherein said reagent includes a mixture of nitric acid and hydrofluoric acid, and said shower head is formed of a material resistant to said mixture of acids.

28. A shower head device according to claim 18, wherein said material includes polypropylene.

* * * * *